US008069983B2

(12) United States Patent
Cross

(10) Patent No.: US 8,069,983 B2
(45) Date of Patent: Dec. 6, 2011

(54) PACKAGE FOR A SAW BLADE

(75) Inventor: Brandon Seth Cross, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 77 days.

(21) Appl. No.: 12/234,134

(22) Filed: Sep. 19, 2008

(65) Prior Publication Data

US 2010/0072093 A1 Mar. 25, 2010

(51) Int. Cl.
*A45C 11/26* (2006.01)

(52) U.S. Cl. ..... 206/349; 206/303; 206/493; 206/495; 206/470

(58) Field of Classification Search ..... 206/349, 206/493, 308.1, 459.5, 779, 495, 327, 485.1, 206/485, 470, 303
See application file for complete search history.

(56) References Cited

U.S. PATENT DOCUMENTS

| | | | | | |
|---|---|---|---|---|---|
| 2,471,173 | A | | 5/1949 | Taylor | |
| 3,259,231 | A | * | 7/1966 | Romanowski et al. | 206/349 |
| 3,987,900 | A | * | 10/1976 | Tadokoro et al. | 206/313 |
| 4,588,082 | A | | 5/1986 | Ridings | |
| 4,884,718 | A | * | 12/1989 | Leahy | 220/835 |
| 5,060,814 | A | * | 10/1991 | Oglesbee | 220/833 |
| 5,456,057 | A | * | 10/1995 | Bannon et al. | 53/449 |
| 5,692,611 | A | * | 12/1997 | Harrison | 206/418 |
| 5,772,022 | A | * | 6/1998 | Renna | 206/312 |
| 6,024,224 | A | * | 2/2000 | Gnadt et al. | 206/763 |
| 6,164,447 | A | * | 12/2000 | Svetlik | 206/373 |
| 6,267,239 | B1 | | 7/2001 | Maki | |
| 6,729,468 | B1 | * | 5/2004 | Dobmeier | 206/303 |
| 6,868,966 | B2 | | 3/2005 | German, III | |
| 7,066,327 | B2 | | 6/2006 | Baublitz et al. | |

* cited by examiner

*Primary Examiner* — Mickey Yu
*Assistant Examiner* — Chun Cheung
(74) *Attorney, Agent, or Firm* — Dennis J. Williamson; Moore & Van Allen, PLLC; Andrew D. Gerschutz

(57) ABSTRACT

A package for a saw blade comprises a housing defining a space for receiving a saw blade. A first cover is attached to the housing at a hinge, and is pivoted at the hinge so as to overlay the saw blade and retain the saw blade in the housing. The cover is dimensioned to extend over less than the entire saw blade. A compartment may be attached to the housing where a security device is located in the compartment. A second cover seals the security element in the compartment. A second cover may be attached to the housing at a second hinge, and pivoted at the second hinge so as to overlay the saw blade and retain the saw blade in the housing. The second cover is dimensioned so as to extend over less than the entire saw blade.

12 Claims, 4 Drawing Sheets

PACKAGE FOR A SAW BLADE

BACKGROUND

The invention relates generally to saw blades and more particularly to packaging for displaying saw blades at the point of purchase.

Different packaging arrangements are known for holding and displaying a saw blade at a point of sale. One such package is disclosed in U.S. Pat. No. 6,729,468. Saw blades are also packaged in folded paper board sleeves and shrink wrapped packages. It is also known to package saw blades in packages comprising a paper board backing with a shrink wrapped covering.

An improved package for a saw blade is desired.

SUMMARY

A package for a saw blade is disclosed comprising a housing defining a space for receiving a saw blade. A first cover is attached to the housing at a hinge, and is pivoted at the hinge so as to overlay the saw blade and retain the saw blade in the housing. The cover is dimensioned to extend over less than the entire saw blade. A compartment may be attached to the housing where a security device is located in the compartment. A second cover seals the security element in the compartment. A second cover may be attached to the housing at a second hinge, and is pivoted at the second hinge so as to overlay the saw blade and retain the saw blade in the housing. The second cover is also dimensioned so as to extend over less than the entire saw blade.

DETAILED DESCRIPTION OF EMBODIMENTS OF THE INVENTION

Figure 1:
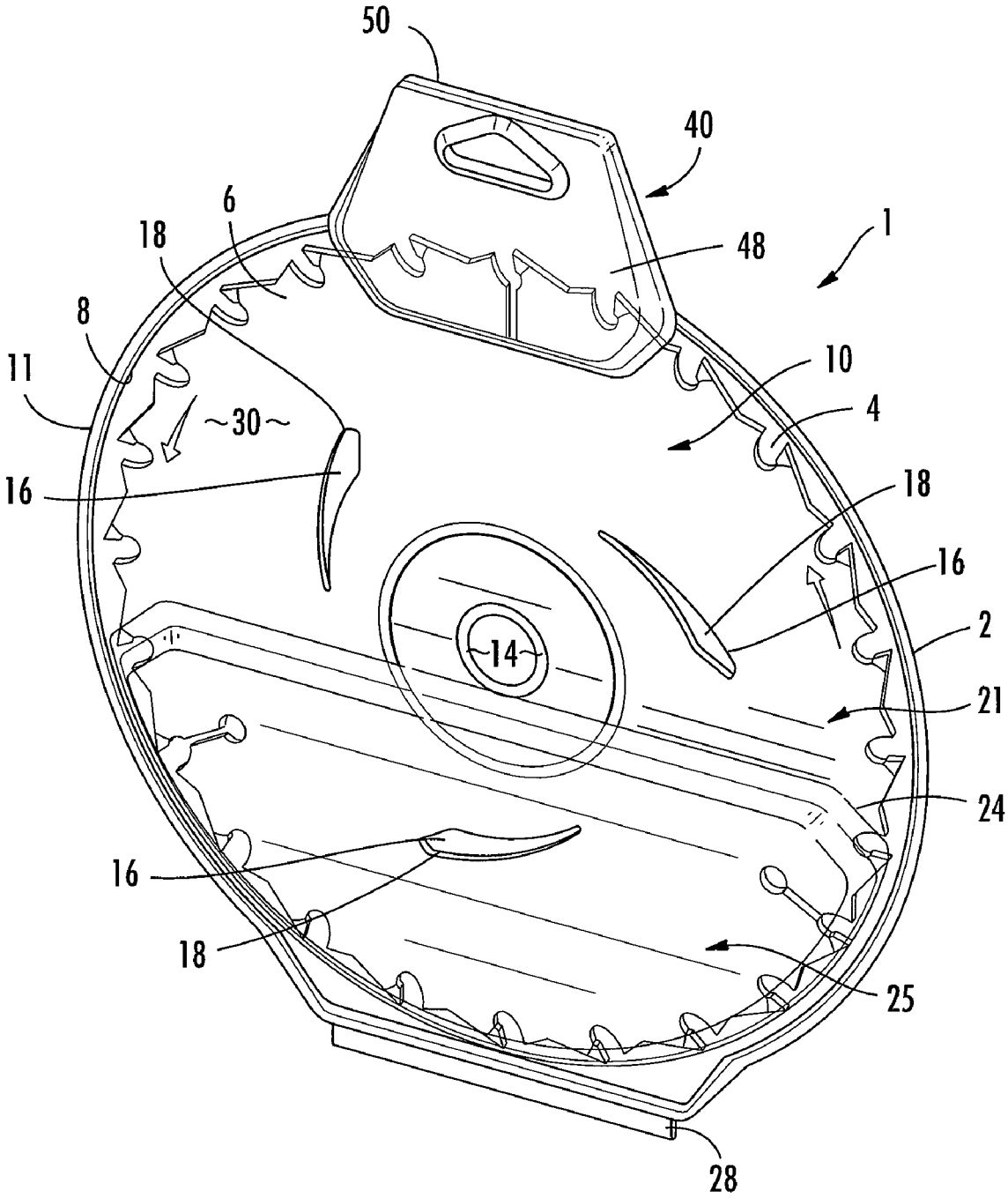
FIG. 1 is a perspective view of an embodiment of the package of the invention in its closed state with a saw blade.
Figure 2:
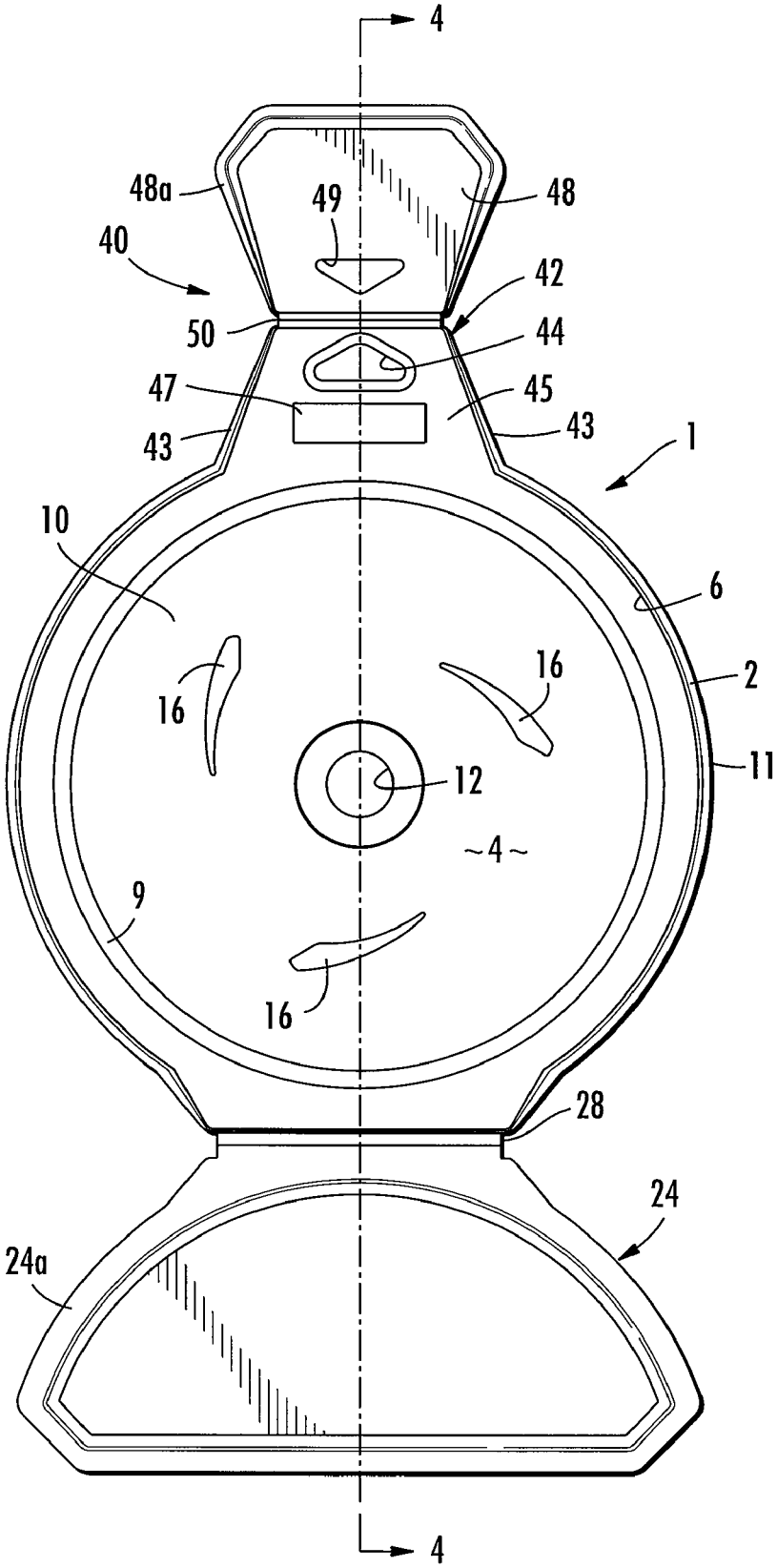
FIG. 2 is a front view of the embodiment of the package of FIG. 1 in its open state.
Figure 3:
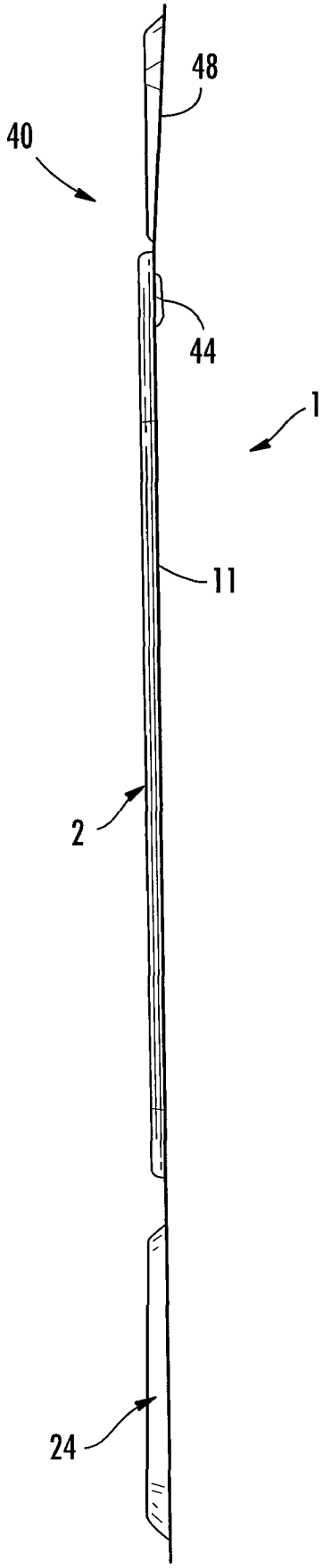
FIG. 3 is a side view of an embodiment of the package of FIG. 1 in its open state.
Figure 4:
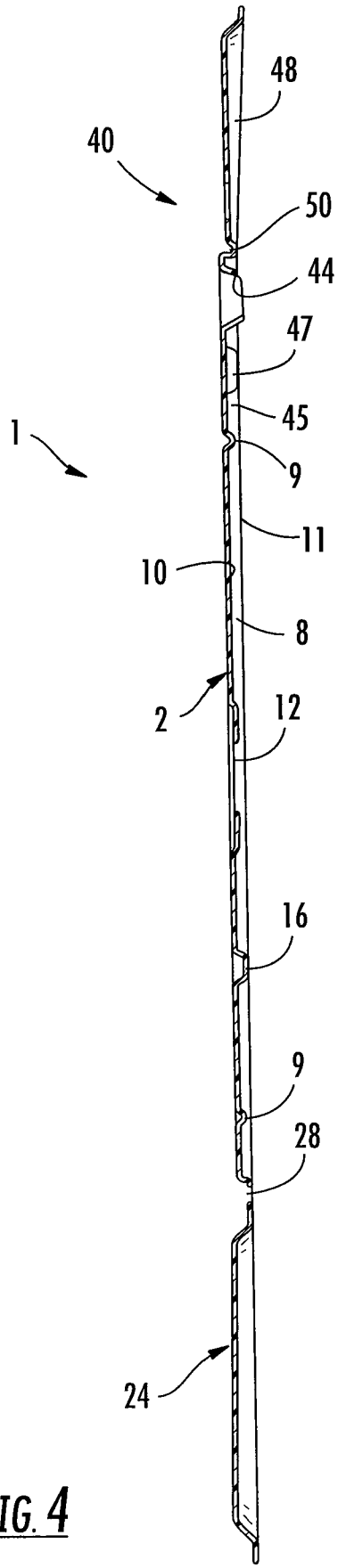
FIG. 4 is a section view taken along line 4-4 of FIG. 2

Referring to FIGS. 1 through 4 the package 1 of the illustrated embodiment consists of a saw blade housing 2. In a preferred embodiment the housing 2 is formed of a relatively hard but flexible plastic material such as thermoplastic, nylon, abs plastic, polycarbonate or the like. Other materials could also be used. The housing 2 comprises a cavity 4 that is formed in the housing and defines an interior space that has a shape that is dimensioned to closely receive the blade 6. In the illustrated embodiment package 1 is designed to retain a circular saw blade 6 such that cavity 4 has a generally circular peripheral edge surface 8 created by raised rim 11 and back surface 10 dimensioned to closely receive saw blade 6. It will be appreciated that circular saw blades come in a variety of sizes such that the diameter of cavity 4 is selected to be slightly greater than the diameter of the blade that is to be retained therein. Further, the cavity 4 is described as generally circular meaning that the wall 8 surrounds a substantial portion of the periphery of the saw blade so as to maintain the saw blade in place in the package. The wall 8 may include gaps and still be considered to be substantially circular as used herein. A raised ridge 9 may be provided that contacts the back side of the saw blade 6 to create space between the blade 6 and the back 10 to facilitate removal of the blade from the package.

Located within the cavity 4 and centrally disposed on back wall 10 is a hole 12 that is located and dimensioned so as to be substantially coextensive with the arbor hole 14 found at the center of a typical circular saw blade. The back wall 10 is also formed with protrusions 16 that comprise areas that are raised relative to back wall 10 and extend into cavity 4. The protrusions 16 engage holes 18 formed on the saw blade to further retain the saw blade in the cavity and prevent the saw blade from rotating relative to the package 1. The holes 18, such as vent holes, are typically formed on the blade as part of the manufacturing process for a circular saw blade such that protrusions 16 can be shaped and dimensioned to engage the preexisting holes 18. The engagement of protrusions 16 with the blade 6 maintains the orientation of the blade in the package such that printed information 21 on the blade such as trademarks, blade size, performance data and the like may be presented in a desired orientation at the point of sale.

Cover 24 is connected to housing 2 at hinge 28. Hinge 28 could be a piece of flexible material that bends to create a living hinge. In the illustrated embodiment, the hinge 28, housing 2 and cover 24 could be molded as a single, integral, unitary formed plastic piece. Alternatively, the housing 4 and cover 24 could be two separate pieces connected by a mechanical hinge such as a hinge pin. Other hinge configurations could also be used.

The cover 24 is dimensioned such that when the cover is rotated over housing 2 at hinge 28 the outside edge 24*a* of the cover 24 is brought into abutting relationship with the rim 11 of the housing. The cover 24 is dimensioned such it covers only a portion of the cavity 4 such that in the uncovered area the blade 6 is exposed. In the illustrated embodiment the cover 24 overlays approximately half of the blade 6 such that the blade 6 is retained in the cavity 4 yet a significant portion of the blade 6 is exposed where it can be touched by a user at the point of purchase. In addition to retaining the blade in the cavity 4, the cover 24 provides an area on the front of the package that can accommodate printed product information 25 such as trademarks, price and sales, information, promotional information or the like that is presented to the user at the front of the blade. The "front" as used herein is the portion of the package that faces the user at the point of purchase. The information 25 can be printed directly on the cover or a sticker or decal may be applied to the cover 24. The cover 24 is secured to the housing 2 along the abutting contact between rim 11 and edge 24*a* by any suitable means including sonic welding, adhesive, a pressure fit or the like.

Located at a position about the periphery of the cavity 4 spaced from the cover 24 is a hang tag/security compartment 40. In the illustrated embodiment the hang tag/security compartment 40 is located opposite the cover 24 such that when the package 1 is suspended by the hang tag at a point of purchase display the hang tag/security compartment is positioned at the top of the package and the cover 24 covers the bottom portion of the blade 6. The hang tag/security compartment 40 comprises an extension 42 that extends from housing 2 and defines an aperture 44. Extension 42 defines a cavity 45 for receiving a security device such as an RFID security tag 47. Other types of security devices may also be used.

A cover 48 is attached to the extension 42 at hinge 50. Hinge 50 could be a piece of flexible material that bends to create a living hinge. In the embodiment illustrated in the figures, the hinge 50, housing 2, extension 42, cover 48, cover 24, and hinge 28 may be a single, integral, unitary formed plastic piece. In one embodiment the entire package is made of thermoformed plastic. The package may also be molded. Alternatively, the cover 48 could be formed as a separate piece from the extension 42 that are connected together by a mechanical hinge such as an inserted hinge pin. Other hinge configurations could also be used.

The cover 48 is dimensioned such that when the cover 48 is rotated over extension 42 at hinge 50, a portion 48*a* of cover 48 is brought into abutting relationship with the rim 43 of extension 42. The cover 48 is dimensioned such it also covers a portion of the cavity 4 such that in the closed position the cover 48 extends over a portion of the blade 6. The cover 48 overlays enough of the top of the blade 6 such that the blade is securely retained in the cavity 4 and cannot be removed from the package without at least partially destroying the package 1. The cover 48 is secured to the extension 42 along the abutting portions by any suitable means including sonic welding, adhesive, a pressure fit or the like. In the closed position shown in FIG. 1 the blade is securely retained between housing 2, cover 24 and cover 48. When the cover 48 is closed, the cover 48 includes an aperture 49 that is substantially coextensive with aperture 44 to receive a peg or the like at a point of purchase display.

Further, the security device 47 is located in compartment 45 and is trapped between the extension 42 and cover 48 such that it cannot be removed without destroying the package. Prior to closing cover 48 the security device 47 is located within compartment 45. Security device 47 may be attached to the package by adhesive or other securement mechanism. When the cover 48 is secured in the closed position, the security device 47 cannot be accessed by a customer in the retail environment. Thus, the security device 47, secured in compartment 45, cannot be separated from the saw blade 6 that is secured between housing 2 and covers 24 and 48.

While in the illustrated embodiment the hang tag and security compartment are formed as a part of a single extension, the hang tag may be formed separately from the security compartment. For example, the extension 42 with the aperture 44 may be provided on the top of the package to function as the hang tag and a second extension 42 with a cover 48 and inserted security device 47 may be provided offset slightly from the hang tag to function as the security compartment. In such an embodiment the security compartment 45 with the closeable cover 48 is positioned along the housing 2 spaced from the hang tag. A portion of the cover 48 covers a portion of the saw blade as previously described.

Specific embodiments of an invention are described herein. One of ordinary skill in the art will recognize that the invention has other applications in other environments. In fact, many embodiments and implementations are possible. The following claims are in no way intended to limit the scope of the invention to the specific embodiments described above.

The invention claimed is:

1. A package and a saw blade comprising:

a saw blade;

a housing defining a space for receiving the saw blade;

a first cover attached to the housing at a hinge, and pivoted at said hinge so as to cover said saw blade and retain said saw blade in said housing, said first cover being dimensioned to extend over less than the entire saw blade such that a portion of said saw blade is exposed through the package;

a compartment attached to said housing;

a security device located in said compartment;

a second cover attached to the housing at a second hinge, and pivoted at said second hinge to seal said security device in said compartment and to overlay a portion of said saw blade such that the saw blade is retained in the housing by the first cover and the second cover and said saw blade is exposed; and at least two protrusions spaced from the center of said housing for engaging holes formed in the circular saw blade to prevent the saw blade from rotating relative to the housing, wherein at least one of the protrusions is on a portion of the housing exposed between the first cover and the second cover.

2. The package and saw blade according to claim 1, wherein an aperture is formed in said compartment, said aperture being adapted to suspend the package at a point of sale display.

3. The package and saw blade according to claim 1, further including a hole formed in said housing and being coextensive with an arbor hole formed in the circular saw blade.

4. The package and saw blade according to claim 2, wherein said second cover includes a second aperture that at least partially overlays said aperture.

5. The package and saw blade according to claim 1, wherein said housing, said first cover and said second cover are formed of a single piece of material.

6. The package and saw blade according to claim 5, wherein said material is plastic.

7. The package and saw blade according to claim 5, wherein said material is substantially transparent.

8. The package and saw blade according to claim 1, wherein said hinge and said second hinge comprise living hinges.

9. The package and saw blade according to claim 1, wherein said first cover is sonically welded to said housing.

10. The package and saw blade according to claim 1, wherein said security device is an RFID tag.

11. The package and saw blade according to claim 1, wherein printed material is located on the outside surface of said first cover.

12. A package and a circular saw blade comprising:

a saw blade including a vent hole;

a housing defining a space for receiving the saw blade and comprising a protrusion for engaging the vent hole to prevent the saw blade from rotating relative to the housing and a compartment attached to said housing, a security device located in said compartment;

a first cover attached to the housing at a hinge, and pivoted at said hinge so as to cover said saw blade and retain said saw blade in said housing, said first cover being dimensioned to extend over less than the entire saw blade; and a second cover attached to the housing at a second hinge, and pivoted at said second hinge to seal said security device in said compartment, said second cover overlaying said saw blade and being dimensioned to extend over less than the entire saw blade, said first cover and said second cover being dimensioned such that the saw blade is exposed between said first cover and said second cover, wherein the protrusion is on a portion of the housing exposed between the first cover and the second cover.

* * * * *